United States Patent [19]

Cornell

[11] Patent Number: 4,825,561

[45] Date of Patent: May 2, 1989

[54] CURING OVEN APPARATUS

[75] Inventor: Donald E. Cornell, Shawnee, Kans.

[73] Assignee: Owens-Corning Fiberglas Corporation, Toledo, Ohio

[21] Appl. No.: 614,359

[22] Filed: May 29, 1984

[51] Int. Cl.[4] ..... F26B 25/00; F27B 9/00; F27D 1/18; C21B 7/24

[52] U.S. Cl. ..... 34/242; 266/179; 432/144; 432/242

[58] Field of Search ..... 34/242; 432/144, 145, 432/242; 266/179

[56] References Cited

U.S. PATENT DOCUMENTS

| | | | |
|---|---|---|---|
| 2,062,025 | 11/1936 | Harrington | 34/242 |
| 2,304,692 | 12/1942 | Hurxthal et al. | 34/242 |
| 2,336,698 | 12/1943 | Morrill | 34/242 |
| 2,820,307 | 1/1958 | Bogaty | 34/242 |
| 4,192,516 | 3/1980 | McCort | 277/12 |
| 4,490,927 | 1/1985 | Kissell | 34/242 |

*Primary Examiner*—John J. Camby

*Attorney, Agent, or Firm*—Patrick P. Pacella; Thomas F. McGann

[57] ABSTRACT

A flexible screen mounted to pneumatically seal the sides of an opposing belt conveyor system in a porous pack curing oven. Fixed to the upper belt structure and drapingly sealed to the lower belt structure, the screen impedes curing gases directed through the foraminous belts and porous pack therebetween from exiting through the edges of the pack. The draping screen provides a seal over a range of belt-to-belt spacing.

7 Claims, 2 Drawing Sheets

CURING OVEN APPARATUS

BACKGROUND OF THE INVENTION

This invention pertains to curing of porous packs of impregnated material in an enclosed space such as a box.

In one of its more specific aspects, this invention relates to heat curing of binder-impregnated packs of fibrous material in an oven in which hot gas moving perpendicular to the pack is forced through the pack as the pack is conveyed through the oven.

Description of the invention is presented herein relative to mineral fibers such as glass fibers. However, the invention is applicable to any porous material through which gas is forced in an enclosed space.

Forming glass fibers, impregnating the fibers with a binder, collecting the fibers into a pack on a forming conveyor or chain, compressing the uncured pack to the desired thickness or height, and conveying the compressed pack through a curing oven while passing hot gas perpendicularly through the pack to cure the binder, are well-known. Products made in this fashion comprise thermal insulation and ceiling panels.

The curing oven usually comprises two flat, foraminous, moving, endless conveyor belts, one located parallel to and above the other, which belts travel lineally through the oven so that the pack is moved by, between, and in constant contact with both belts. The thickness of the cured pack is determined by the distance between the flat, facing surfaces of the belts. This distance, called the bridge height, is adjustable to facilitate production of varying pack thicknesses. The bottom belt elevation relative to the oven structure is fixed; the top belt elevation, or bridge height, is adjustable.

The foraminous conveyor belts usually comprise a series of foraminous slats, or flights, which are fixed to a pair of conveyor chains. The flights are fitted across the chains, side-by-side in contact relationship. A blower pressurizes the back side of one of the conveyor belts so that hot gas is forced through the foraminous flights, through the pack, then through the opposing flights.

The hot gas driven by the blower is forced through the pack in a direction perpendicular to the pack surface in contact with the flights. However, because the sides of the conveyor belt system are open to the interior of the oven, a significant portion of the hot gas is forced through the pack edges, bypassing the opposing flights. This can cause the edges of pack to overcure, to burn, and to be eroded. Attempts to solve this bypass problem have involved placement of metal brushes between the top conveyor belt, or bridge, and the oven shell sides. Because the bridge must move up and down inside the oven shell to change the pack thickness, the brushes must move up and down in contact with the oven shell. Because the oven shell inner surface is not a plane, mainly because of the discontinuities occasioned by the cleanout doors on the oven sides, the brushes cannot bear continuously on the oven shell at all bridge settings. Accordingly, use of brushes was not a satisfactory solution to the bypass problem. The invention described herein impedes hot gas bypass flow, promoting even, complete, and appropriate degree of cure, without pack edge overcure, burn, or erosion. The apparatus of this invention is durable, heat resistant, and is not dependent upon a mating seal with the oven shell sides for operability. The apparatus seals pneumatically the pack-curing space between the belts from the oven shell space. Sealing pneumatically is defined as employment of a sealing apparatus capable of impeding or prohibiting movement of gas from one space to another.

It is possible to use both the brushes and the apparatus of this invention simultaneously to control curing gas bypass.

SUMMARY OF THE INVENTION

According to this invention, there is provided in a porous pack curing box an apparatus for sealing pneumatically the pack-curing space between the facing, parallel surfaces of a pair of foraminous, vertically stacked oven conveyor belts, from the curing box inner shell so as to impede curing gas forced perpendicularly through the foraminous belts and pack from bypassing the pack by exiting through the pack edges. The apparatus comprises screens sealingly fixed to the upper belt structure and drapingly sealed to the lower belt structure, on each side of the oven.

In another embodiment of the invention, the pack-curing space height is adjustable.

In another embodiment, the belts are mounted to move lineally through the box.

In another embodiment, at least one of the belts is continous.

In another embodiment, the screens comprise woven, flexible, metallic wire.

In the preferred embodiment of the invention, the curing box is an oven and the curing gas is hot.

DESCRIPTION OF THE PREFERRED EMBODIMENT

The invention will be discussed in terms of the preferred embodiment without meaning to limit the invention thereto.

Figure 1:
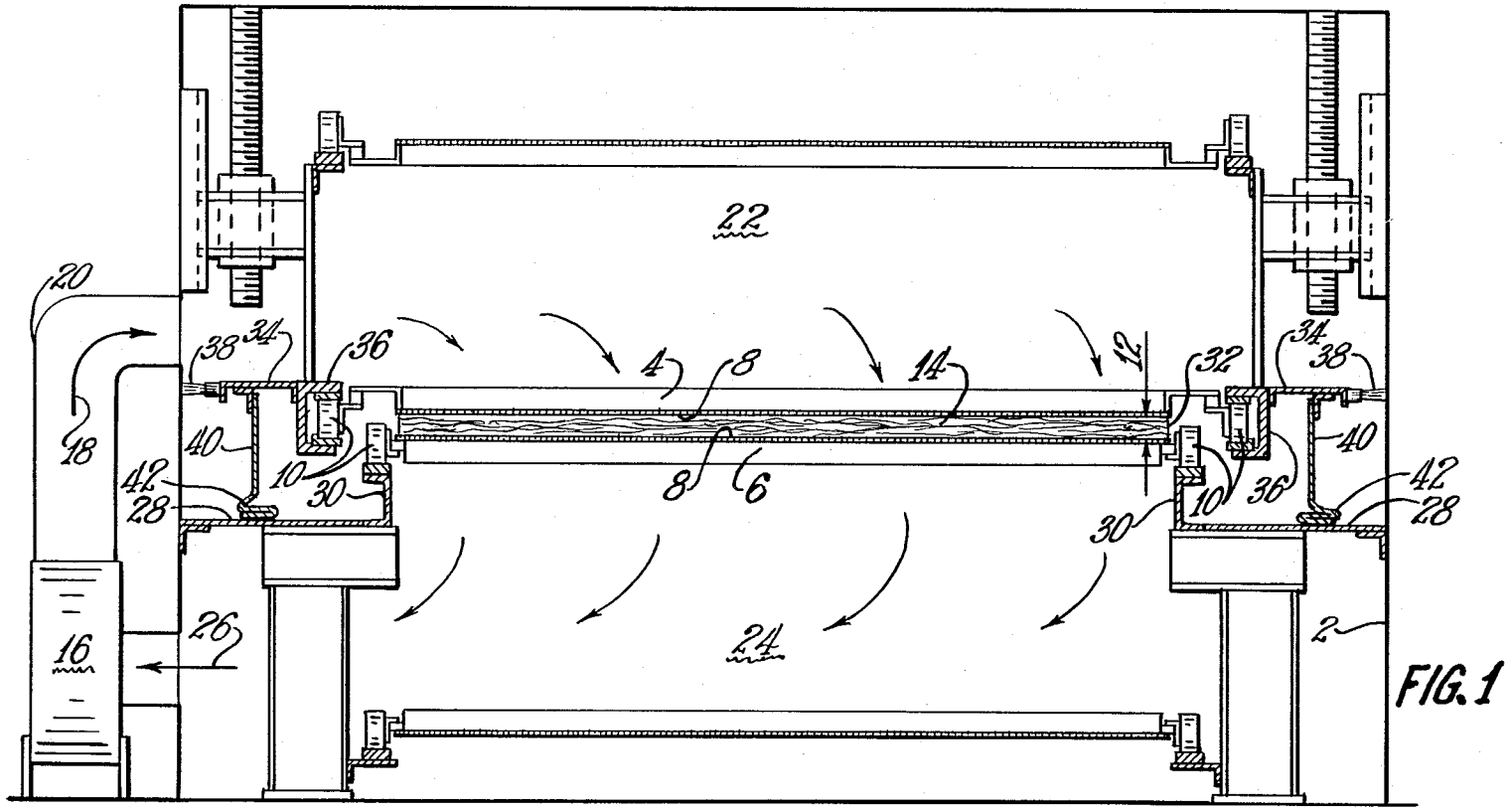
FIG. 1 is a schematic, front elevation view of a curing oven using the principles of this invention.

FIG. 1 shows the curing oven shell 2 which encloses top conveyor belt 4 and bottom conveyor belt 6. Each belt comprises foraminous flights 8 which are fixed to driven conveyor chains 10 in a side-by-side contact arrangement. The two belt surfaces formed by the flights are parallel, spaced-apart, and driven at the same speed in the same direction. The distance 12 between the parallel flight surfaces, called bridge height, is adjustable. The work piece, binder-impregnated porous pack 14, is conveyed through the curing oven in contact with both flight surfaces. The thickness of the pack is determined by the bridge height.

Blower and heater means 16 generates hot curing gas 18 which is forced through supply duct 20 into top chamber 22 above the top belt. The hot gas passes through the top belt foraminous flights, through the porous pack, and through the bottom belt foraminous flights into chamber 24. Exhaust duct 26 returns the curing gas to the blower and heater means for recycling. In the case of a multizone oven, the exhaust duct routes the curing gas to the next zone or to a blower and heater means for the next zone. Subsequent progressive routing can be to either the top or bottom chamber of each zone.

Bottom shelf 28 is sealingly fixed to and between bottom belt support structure 30 and the oven shell. This encloses the bottom chamber so that hot curing gas can exit the chamber only through the foraminous flights of the belt or through the exhaust duct. Unless a structure is provided to pneumatically seal the porous pack from the oven shell, a significant amount of curing gas will exit the porous pack at pack edge 32, bypassing the foraminous flights of the bottom belt. To inhibit this bypass, top shelf 34 is sealingly fixed to the top belt support structure, or bridge, 36. To permit bridge height adjustment, the top shelf cannot be fixed to the oven shell; a moveable seal between the top shelf and the oven shell is necessary. Past practice provided the moveable seal by use of metal brushes 38. However, where discontinuities in the oven shell exist, such as at cleanout doors, the brushes do not seal. The instant invention, flexible screen 40, solves this problem. Sealingly fixed to and hanging from the top shelf along the length of the curing oven, the flexible screen is of suitable length to form a serpentine drape 42 on the bottom shelf, in pneumatically sealing contact with the bottom shelf at the smallest and largest bridge height adjustment. The screen can be of any suitable material and configuration necessary to withstand the heat of curing and the chemistry of the curing gas and work piece, to maintain its placement in sealing draping contact with the bottom shelf, to withstand hot gas erosion, and to present a suitable impediment to gas flow. The following screen material has been found to be suitable for use in multizoned, thermal curing ovens for building insulation:

balanced wire belting
2500 mesh count
B-72-72-16
16 ga. 304 stainless steel wire
diagonal crimp rods and welded selvage
Cambridge Wire Cloth designation 501-228-3000.

Figure 2:
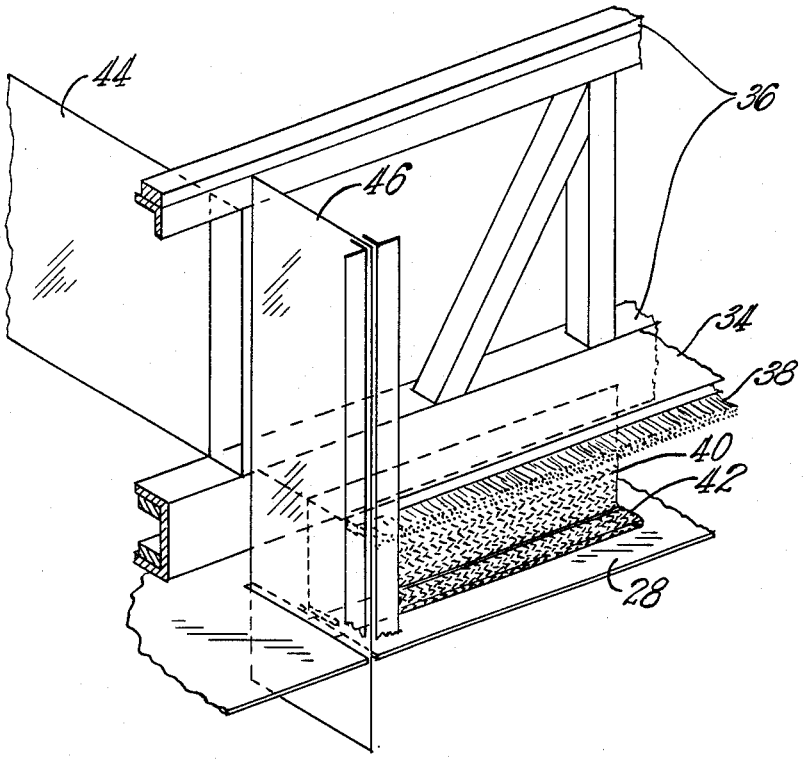
FIG. 2 is a schematic pictorial view showing the relationship of the invention and existing oven baffles.

FIG. 2 shows typical zone baffles 44 and 46 which separate the oven into the desired number of zones. Both baffles are fixed to the bridge 36, baffle 44 extending completely across the bridge structure, and baffle 46 extending from the bridge structure to the oven shell. The screen 40 abutts baffle 46 as this baffle travels with the bridge during bridge height adjustment.

The metallic screen described is not in itself highly inhibitory to gas flow, but soon after initial installation and operation of a clean screen, pack components such as binder and fiber build up on the pack-side surface of the screen, rendering the screen suitably inhibitory to gas flow in this application.

Depending on the product and the oven-type, it may be necessary to operate with a screen that ranges in gas permeability from moderately permeable to virtually impermeable. The initial screen permeability, and the screen cleaning interval, can be chosen to address the requirements for a particular product and oven combination.

It is possible for this invention to operate in conjunction with the described brushes, but it will operate effectively as the sole impediment to hot gas bypass through the porous pack edges.

It is evident from the foregoing that various adjustments and modifications can be made to the apparatus of this invention. Such, however, are within the scope of this invention.

I claim:

1. An apparatus for curing a porous pack having a bottom side, a top side, and two edges, comprising:

a. a box having a curing zone and an inner shell;
b. a bottom foraminous belt disposed within said box and contacting said porous pack bottom side;
c. a top foraminous belt extending in the same direction as said bottom belt and disposed within said box in a parallel and spaced apart relationship with and directly over said bottom belt, and contacting said porous pack top side;
d. means to move curing gas substantially vertically through said belts and said porous pack; and p1 e. a pair of screens, one disposed at each edge of and adjacent to said belts and extending along the length of said curing zone, mounted pneumatically sealingly to isolate the space between said belts from said inner shell, within which said space is located said porous pack, thereby impeding movement of said curing gas through said edges of said porous pack.

2. The apparatus of claim 1 wherein said space between said belts is adjustable in height.

3. The apparatus of claim 1 wherein said top and said bottom belts are mounted to move through said box.

4. The apparatus of claim 1 wherein said box is an oven.

5. The apparatus of claim 3 wherein at least one of said belts is continuous.

6. The apparatus of claim 1 further comprising a top belt support structure and a bottom belt support structure, wherein said screens are flexible and mounted on said top belt support structure so as to drape on said bottom belt support structure, thereby pneumatically sealingly isolating said space between said belts from said inner shell as height of said space is adjusted.

7. The apparatus of claim 6 wherein said flexible screen comprises woven metal wire.

* * * * *